US011425491B2

(12) United States Patent
Su et al.

(10) Patent No.: US 11,425,491 B2
(45) Date of Patent: Aug. 23, 2022

(54) DISPLAY AND SOUND EMITTING DEVICE THEREOF

(71) Applicant: Qisda Corporation, Taoyuan (TW)

(72) Inventors: Yung-Chun Su, Taoyuan (TW); Weng-Ching Hsieh, Taoyuan (TW); Chung-Hao Yang, Taoyuan (TW); Hung-Mao Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/184,672

(22) Filed: Feb. 25, 2021

(65) Prior Publication Data

US 2021/0274279 A1 Sep. 2, 2021

(51) Int. Cl.
*H04R 1/34* (2006.01)
*H04R 1/02* (2006.01)

(52) U.S. Cl.
CPC ..... *H04R 1/345* (2013.01); *H04R 1/028* (2013.01); *H04R 2400/11* (2013.01); *H04R 2499/15* (2013.01)

(58) Field of Classification Search
CPC .... H04R 1/345; H04R 1/028; H04R 2400/11; H04R 2499/11
USPC ..... 381/333
See application file for complete search history.

(56) References Cited

U.S. PATENT DOCUMENTS 9,538,271 B2 * 1/2017 Iwaya ..... H04R 1/021
9,602,914 B2 * 3/2017 Shedletsky ..... H04R 1/2834
2002/0057816 A1 5/2002 Kelly et al.
2012/0051570 A1 * 3/2012 Arche ..... H04B 5/0081 381/315
2013/0251183 A1 * 9/2013 Doller ..... H04R 1/086 381/361
2019/0098121 A1 * 3/2019 Jeon ..... H04M 1/18
2020/0169816 A1 * 5/2020 Kim ..... G06F 1/1658

FOREIGN PATENT DOCUMENTS

CN 201303414 Y 9/2009
CN 204131695 U 1/2015
CN 205961397 U 2/2017
KR 10-2013-0112215 A 10/2013

OTHER PUBLICATIONS

Office action of counterpart application by Taiwan IP Office dated Nov. 9, 2020.

* cited by examiner

*Primary Examiner* — Sean H Nguyen

(57) ABSTRACT

A display including a front frame, a rear case, a display panel and a sound emitting device is provided. The display panel is disposed between the front frame and the rear case, and a display surface of the display panel is exposed from the front frame. The sound emitting device is disposed between the front frame and the rear case and includes a sound box, a speaker unit and a sound guide channel. The speaker unit disposed on the sound box has a sound emitting surface facing a first direction. The sound guide channel is extended to the sound emitting surface and has a sound outlet facing a second direction. The first direction is not parallel to the second direction.

14 Claims, 7 Drawing Sheets

DISPLAY AND SOUND EMITTING DEVICE THEREOF

This application claims the benefit of People's Republic of China application Serial No. 202010129806.6, filed Feb. 29, 2020, the subject matter of which is incorporated herein by reference.

BACKGROUND OF THE INVENTION

Field of the Invention

The invention relates in general to a display, and more particularly to a display with a sound emitting device.

Description of the Related Art

Along with the development in the electronic technology, display has been widely used in education, business and household. For a display with the sound emitting device, the sound emitting device can be additionally disposed under the front frame and will be exposed outside the display. However, such external sound emitting device will result in an asymmetric appearance of the display. Furthermore, the sound emitted by the speaker unit of the sound emitting device can be propagated upwards, backwards or forwards to reach the desired sound field effect, such as 360° surround sound, multimedia context, high sound quality and heavy bass. However, the change in the sound emitting direction of the speaker unit will not match the thin or ultra-thin appearance design of current display. If an external speaker unit is installed just to increase the sound emitting quality, the external speaker unit will occupy the surrounding space of the display and will make the environment messy.

SUMMARY OF THE INVENTION

The invention is directed to a display with a sound emitting device capable of maintaining the slim appearance design of the display as well as changing the sound emitting direction of the speaker unit.

According to one embodiment of the present invention, a display including a front frame, a rear case, a display panel and a sound emitting device is provided. The display panel is disposed between the front frame and the rear case, and a display surface of the display panel is exposed from the front frame. The sound emitting device is disposed between the front frame and the rear case and includes a sound box, a speaker unit and a sound guide channel. The speaker unit disposed on the sound box has a sound emitting surface facing a first direction. The sound guide channel is extended to the sound emitting surface and has a sound outlet facing a second direction. The first direction is not parallel to the second direction.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements. Directional terms such as above, under, left, right, front or back are used in the following embodiments to indicate the directions of the accompanying drawings, not for limiting the present invention.

According to an embodiment of the present invention, a display which allows the installation of sound emitting device without changing the appearance of the display is provided. The display of the present embodiment can be realized by a frameless or thin-frame display and has a front frame and a decking board. The decking board is disposed on the front side of the display and is fixed under the front frame. The sound emitting device of the present embodiment utilizes the existing space at the rear of the decking board without increasing the size of the decking board or the area of the sound outlet, and therefore complies with the slim appearance design of the display.

According to an embodiment of the present invention, the sound emitting device has a speaker unit disposed in the existing space at the rear of the decking board. The sound is emitted by the speaker unit in a downward direction (or in a predetermined direction). The sound emitting device changes the sound emitting direction of the speaker unit through the sound guide channel and makes the sound outlet of the sound emitting device face forwards (or in a predetermined direction), such that the sound emitted by the speaker unit can be propagated along a predetermined direction to achieve the desired sound field effect.

According to an embodiment of the present invention, since the sound emitting surface of the speaker unit faces downward, given that the area of the sound outlet remains unchanged, the vertical cross-sectional area of the speaker unit can be reduced to reduce the vertical space requirement. Therefore, the display of the present embodiment allows the installation of sound emitting device without increasing the size of the decking board or the area of the sound outlet, and therefore complies with the slim appearance design of the display.

Figure 1:
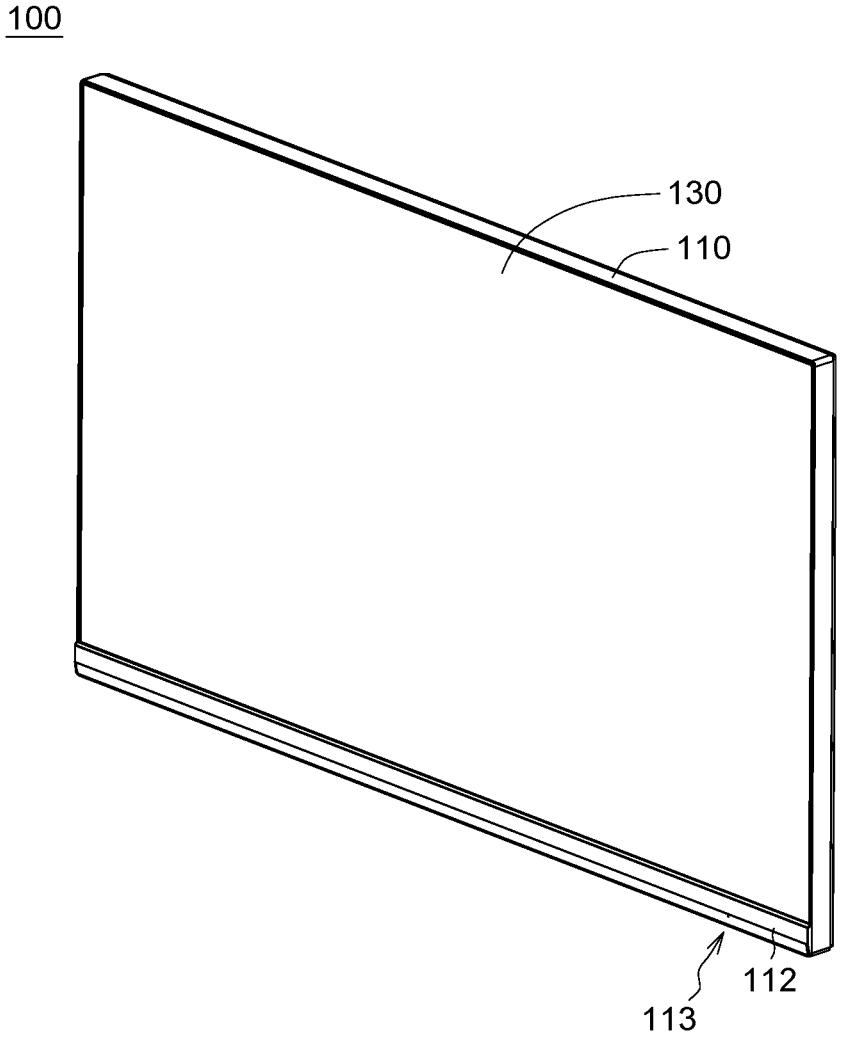
FIG. 1 is a 3D diagram of a display according to a first embodiment of the present invention.
Figure 2:
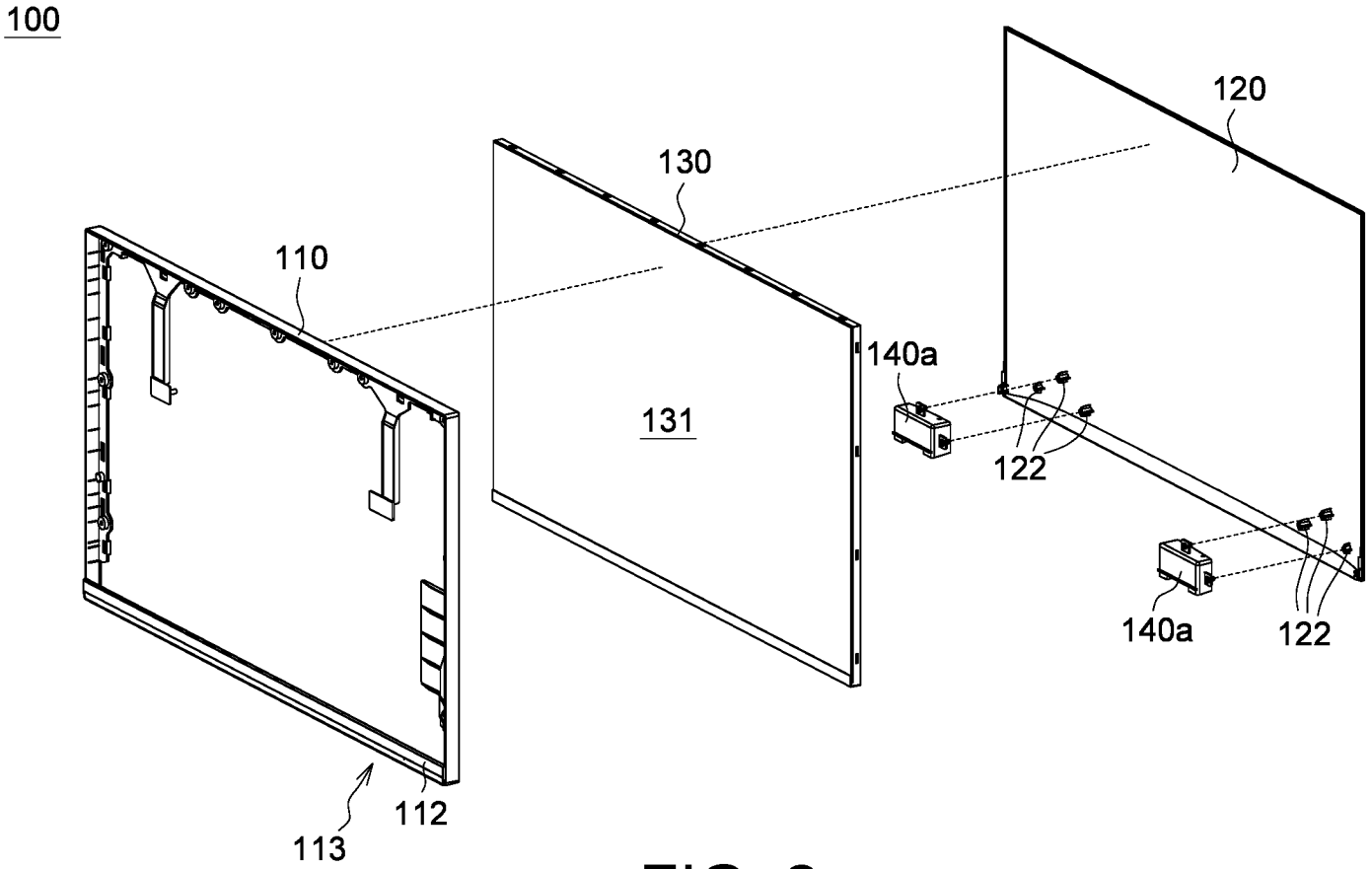
FIG. 2 is an explosion diagram of a display according to a first embodiment of the present invention.

Refer to FIGS. 1 and 2. FIG. 1 is a 3D diagram of a display 100 according to a first embodiment of the present invention. FIG. 2 is an explosion diagram of a display 100 according to a first embodiment of the present invention. The display 100 includes a front frame 110, a rear case 120, a display panel 130 and a sound emitting device 140*a*. The number of sound emitting device 140*a* can be one or more than one. The display panel 130 is disposed between the front frame 110 and the rear case 120, and a display surface 131 of the display panel 130 is exposed from the front frame 110.

In an embodiment, the front frame 110 and the rear case 120 form an accommodation space, in which the display panel 130 is disposed. Besides, the front frame 110 has an opening, in which the display surface 131 of the display panel 130 is exposed. The opening can have a rectangular shape whose aspect ratio is such as 4:3, 16:9 or other ratios.

The display panel 130 can be a liquid crystal display panel or an OLED display panel. The display panel 130, disposed between the front frame 110 and the rear case 120, can be disposed on the front frame 110 or the rear case 120 using several positioning members (such as screws or positioning brackets). In an embodiment, an I/O interface (not illustrated in the diagram), such as power input end, signal input end and signal output end, is disposed on the rear case 120. Through the I/O interface, the display panel 130 can be connected to an external power source and an external signal source. Additionally, the front frame 110 and the rear case 120 can be engaged using screws, latches or fasteners, such that the front frame 110 can be fixed on the rear case 120, and the front frame 110 can cover the edge of the display panel 130 to define the range or size of the display area of the display panel 130.

Refer to FIGS. 1 and 2. In an embodiment, the front frame 110 includes a decking board 112. The decking board 112 includes a sound outlet decking portion 113, such as a porous structure or a mesh structure. The sound outlet decking portion 113 is opposite to the sound outlet 147 of the sound emitting device 140*a*. That is, to avoid the sound emitting device 140*a* being exposed and affecting the appearance design of the display, the front of the sound emitting device 140*a* is covered by the decking board 112. Since the sound outlet decking portion 113 has a porous structure or a mesh structure, the sound emitted by the sound emitting device 140*a* can be propagated to the outside of the display 100 through the sound outlet decking portion 113.

Figure 3:
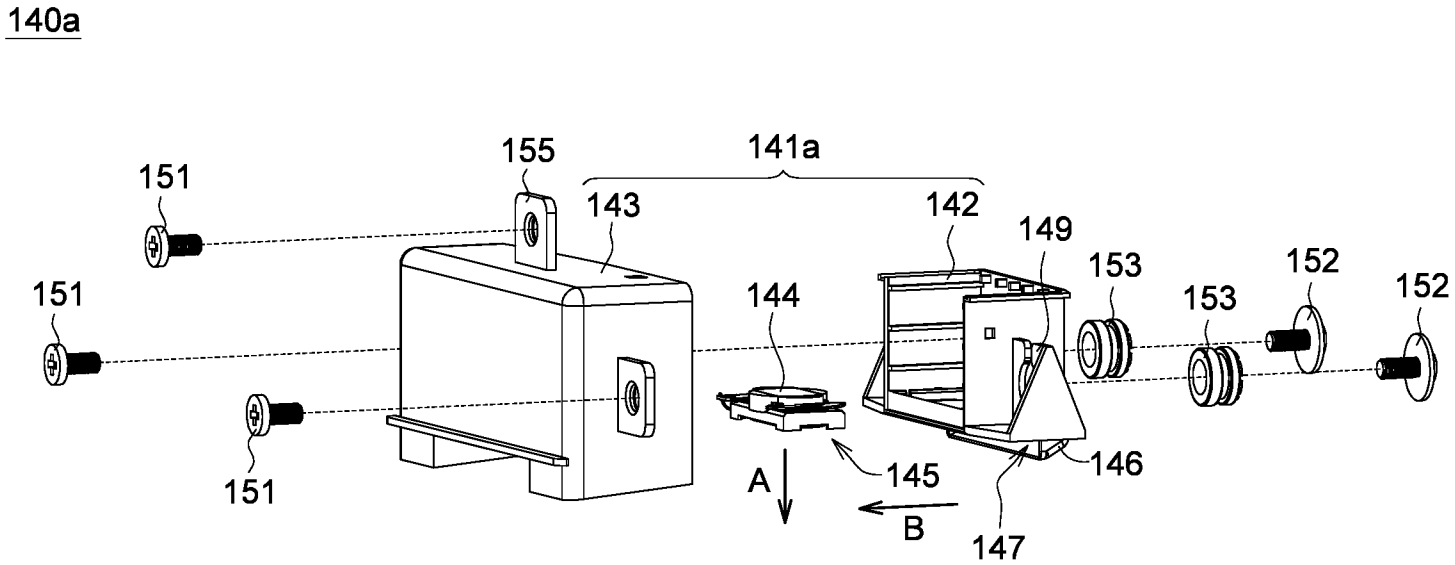
FIG. 3 is an explosion diagram of a sound emitting device according to a first embodiment of the present invention.
Figure 4:
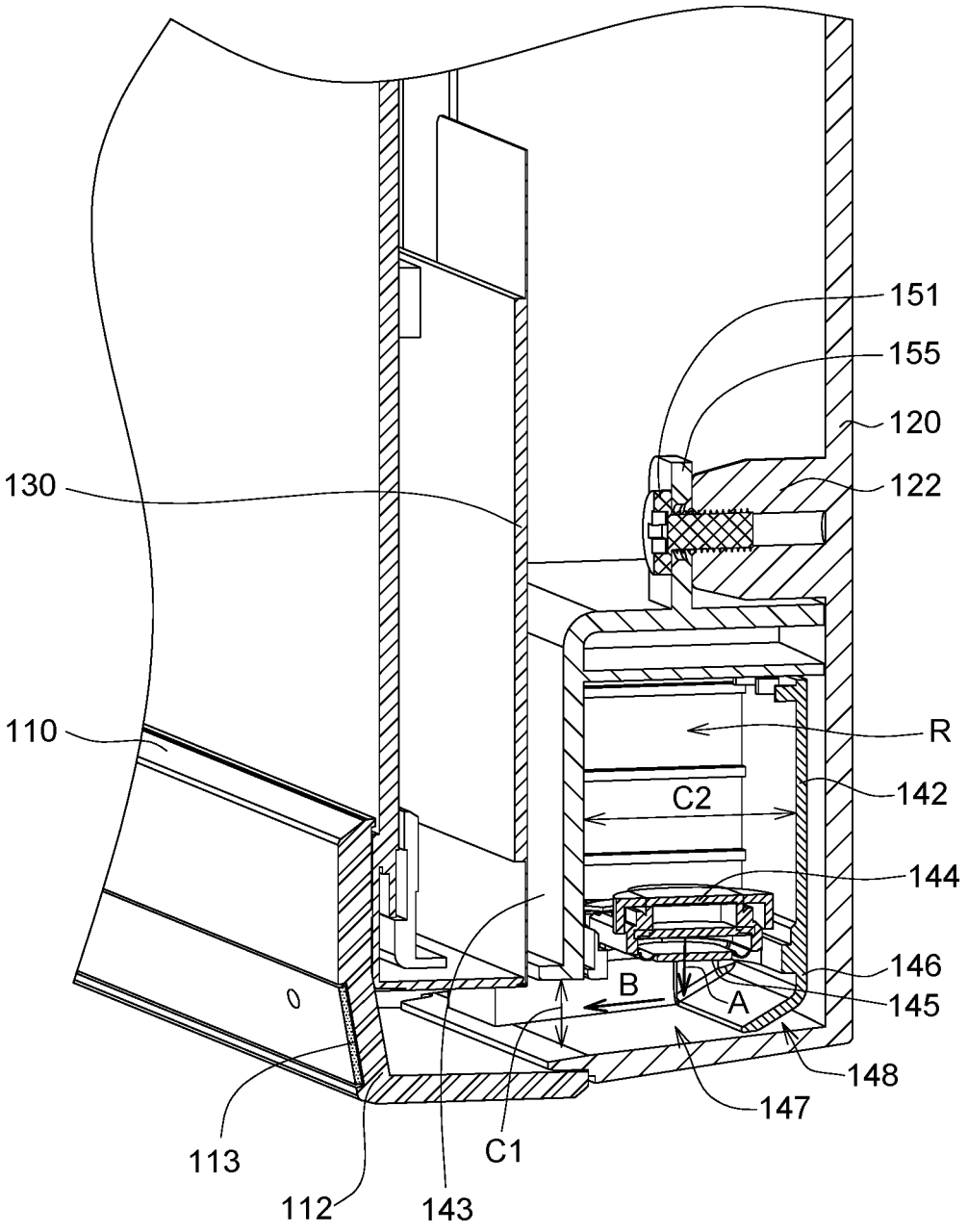
FIG. 4 is a cross-sectional view of a sound emitting device according to a first embodiment of the present invention.

Refer to FIGS. 3 and 4. FIG. 3 is an explosion diagram of a sound emitting device 140*a* according to a first embodiment of the present invention. FIG. 4 is a cross-sectional view of a sound emitting device 140*a* according to a first embodiment of the present invention. The sound emitting device 140*a* includes a sound box 141*a*, a speaker unit 144 and a sound guide channel 146. The speaker unit 144 disposed in the sound box 141*a* has a sound emitting surface 145 facing a first direction A. The sound guide channel 146 is adjacent and connected to the sound emitting surface 145 and has a sound outlet 147 facing a second direction B. The first direction A is not parallel to the second direction B.

In an embodiment, the sound box 141*a* may have several fixing hole portions 155 and a plurality of screws 151 passing through corresponding fixing hole portions 155, and one end of each screw 151 is fixed in the corresponding screw hole 122 of the rear case 120 to fix the sound box 141*a* on the rear case 120 (refer to FIG. 2). However, the present invention is not limited to the way of fixing the sound box 141*a* on the rear case 120 using the screws 151, and the sound box 141*a* can also be fixed on the rear case 120 through other way.

Refer to FIG. 3. In an embodiment, the sound box 141*a* includes a first shell component 142 and a second shell component 143. The speaker unit 144 is disposed on the first shell component 142, the first shell component 142 is disposed on the second shell component 143, and the second shell component 143 is fixed on the rear case 120 using the screws 151. That is, the sound box 141*a* is formed of two shells assembled to each other and provides a cavity for receiving the speaker unit 144. To avoid the two shells generating resonation and making the speaker unit 144 vibrate, the connection between the first shell component 142 and the second shell component 143 has a buffer structure 153 formed of a shock-absorbing material such as rubber or foam. Refer to FIG. 3. The first shell component 142 has a plurality of fixing hole portions 149 and a plurality of screws 152 passing through corresponding fixing hole portions 149, and one end of each screw 152 is fixed in the corresponding screw hole (not illustrated in the diagram) of the second shell component 143 to fix the first shell component 142 on the second shell component 143. In an embodiment, the buffer structure 153, disposed in the fixing hole portions 149, is used to cover the surrounding of the screws 152 and absorb the vibration of the first shell component 142 or the second shell component 143.

Refer to FIG. 4. The sound guide channel 146, disposed under the first shell component 142, is adjacent and extended to the sound emitting surface 145 of the speaker unit 144 disposed in the first direction A. The sound guide channel 146 and the first shell component 142 are, for example, integrally formed in one piece, or the sound guide channel 146 is fixed on the first shell component 142 using an adhesive or the screws, and the present invention does not have specific restrictions regarding the said arrangement. That is, the speaker unit 144 can emit a sound propagated along the first direction A. Additionally, the sound guide channel 146 has a sound guide bevel 148 inclined with respect to the sound emitting surface 145. The sound guide bevel 148, such as a flat bevel, an arced bevel or an S-shaped curved surface, may have a horizontal tilt angle in a range of 5° to 85°, and preferably in a range of 30° to 60°. That is, the speaker unit 144 can emit a sound propagated along the first direction A and then reflected by the sound guide bevel 148 to be propagated along the second direction B. The angle formed by the first direction A and the second direction B can be smaller than 90° or larger than 90°, and the present invention does not have specific restrictions regarding the said arrangement.

Apart from the arrangement that the sound emitting surface 145 of the speaker unit 144 faces a downward direction, the sound emitting surface 145 of the speaker unit 144 can also be obliquely disposed as long as the vertical cross-sectional area of the speaker unit 144 can be reduced. As the sound emitting surface 145 of the speaker unit 144 faces a downward direction, the speaker unit 144 has a smallest vertical cross-sectional area and the vertical space requirement can be reduced. Given that the sound emitting surface of the speaker unit 144 faces a forward direction or a backward direction, the speaker unit 144 will have a largest vertical cross-sectional area, and the vertical space requirement cannot be reduced.

Refer to FIG. 4. The gap between the first shell component 142 and the second shell component 143 forms the sound outlet 147 of the sound guide channel 146, and the sound outlet 147 has a vertical width C1 and a vertical length. That is, the area of the sound outlet 147 is the product of the vertical width C1 and the vertical length. Furthermore, the sound emitting surface 145 of the speaker unit 144 has a horizontal width C2 and a horizontal length. That is, the area of the sound emitting surface 145 is the product of the horizontal width C2 and the horizontal length. In the present embodiment, given that the vertical length and the horizontal length are identical or remain unchanged, the vertical area of the sound outlet 147 can be smaller than the horizontal area of the sound emitting surface 145 or the vertical width C1 of the sound outlet 147 can be smaller than the horizontal width C2 of the sound emitting surface 145 to reduce the vertical space requirement of the sound emitting device 140*a*.

In another embodiment, the area of the sound outlet 147 can be increased when the vertical length of the sound outlet 147 is increased and is greater than the horizontal length of the sound emitting surface 145, and the present invention does not have specific restrictions regarding the said arrangement. Therefore, given that the area of the sound outlet 147 of the sound emitting device 140*a* remains unchanged, the vertical area of the speaker unit 144 of the sound emitting device 140*a* can be reduced. Therefore, the display 100 of the present embodiment allows the installation of sound emitting device without increasing the size of the decking board 112 or the area of the sound outlet 147 and complies with the slim appearance design of the display 100.

Refer to FIG. 4. In an embodiment, the space between the speaker unit 144 and the sound box 141*a* forms a rear sound box R. That is, when an alternate current signal is introduced to the speaker unit 144, the voice coil will perform an axial forward and backward movement according to the frequency and amplitude of the alternate current signal and make the speaker diaphragm perform an axial forward and backward movement accordingly. In an embodiment, the surrounding of the sound box 141*a* can be sealed using an airtight strip (not illustrated in the diagram). The airtight strip can be sealed at the connection between the sound box 141*a* and the rear case 120 to generate a sealed rear sound box R.

To avoid the forward sound and the backward sound generated by the diaphragm interfering with each other, the front space and the rear space (that is, the rear sound box R) in two sides of the speaker unit 144 need to be isolated from each other, such that the sound, apart from being propagated forward via the speaker diaphragm, also can be reflected or resonated in the rear sound box R to generate a sound with resonant frequency. Thus, the sound emitting device of the present embodiment 140*a* can improve the sound quality or sound field by changing the size and shape of the sound guide channel 146 and/or the rear sound box R.

Figure 5:
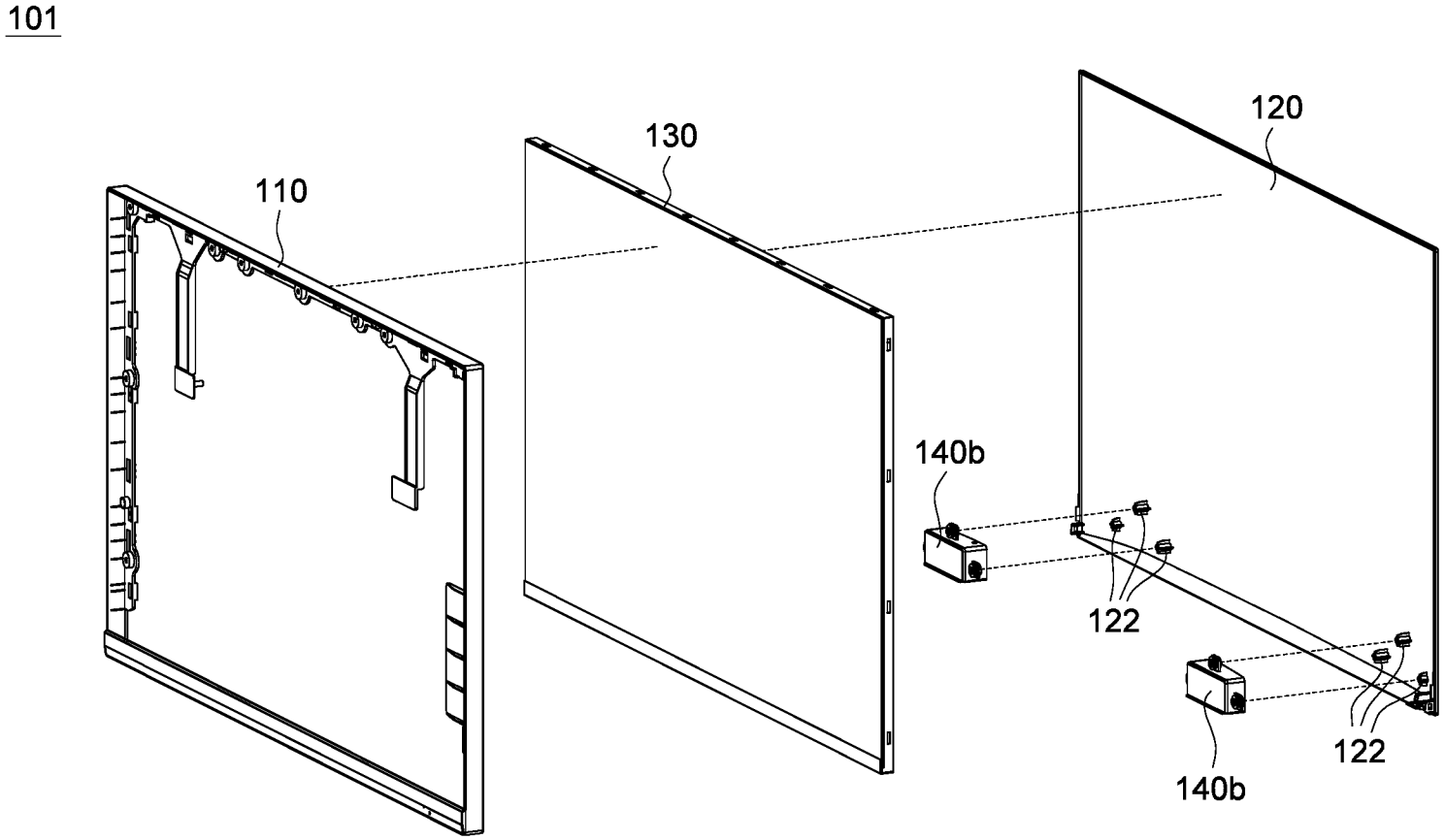
FIG. 5 is an explosion diagram of a display according to a second embodiment of the present invention.
Figure 6:
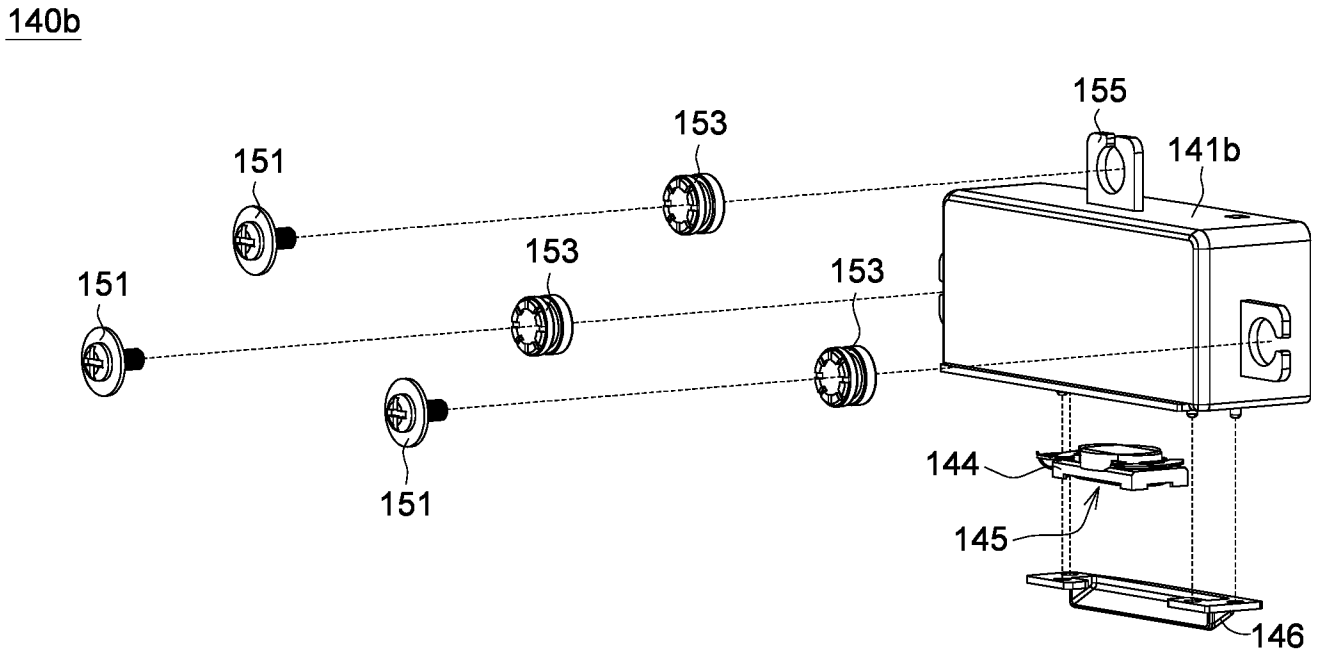
FIG. 6 is an explosion diagram of a sound emitting device according to a second embodiment of the present invention.
Figure 7:
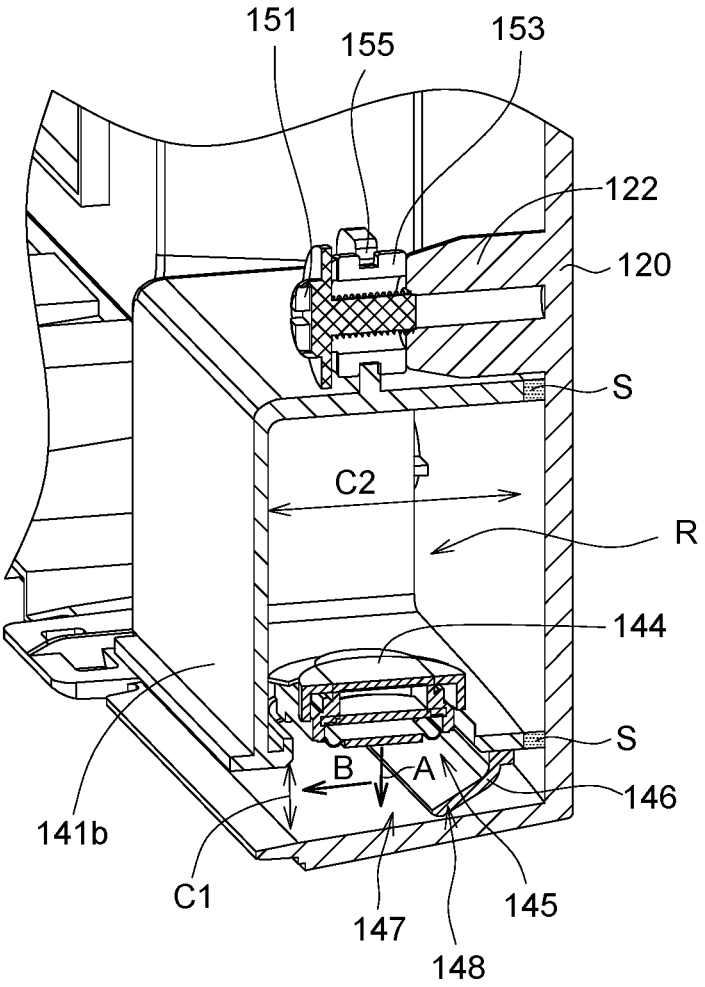
FIG. 7 is a cross-sectional view of a sound emitting device according to a second embodiment of the present invention.

Refer to FIGS. 5-7. FIG. 5 is an explosion diagram of a display 101 according to a second embodiment of the present invention. FIG. 6 is an explosion diagram of a sound emitting device 140*b* according to a second embodiment of the present invention. FIG. 7 is a cross-sectional view of a sound emitting device 140*b* according to a second embodiment of the present invention. Identical or similar elements common to the accompanying drawings are represented by the same designations, and the similarities are not repeated here.

The sound emitting device 140*b* of the present embodiment is different from the sound emitting device 140*a* of the first embodiment in that: the sound box of the sound emitting device 140*b* includes a unitary shell component 141*b* on which the speaker unit 144 is disposed and the sound guide channel 146 is fixed, and the gap between the unitary shell component 141*b* and the sound guide channel 146 forms the sound outlet 147. That is, the sound box is formed of the unitary shell component 141*b* and provides a cavity for receiving the speaker unit 144.

Refer to FIG. 6. The buffer structure 153, disposed in the fixing hole portions 155, is used to cover the surrounding of the screws 151 and absorb the vibration of the unitary shell component 141*b*.

Additionally, the sound guide channel 146, disposed under the unitary shell component 141*b*, is adjacent and extended to the sound emitting surface 145 of the speaker unit 144 disposed in the first direction A. Therefore, the speaker unit 144 can emit a sound propagated along the first direction A and then reflected by the sound guide bevel 148 to be propagated along the second direction B. The first direction A and the second direction B form an angle equal to 90°, smaller than 90° or larger than 90°, and the present invention does not have specific restrictions regarding the said arrangement. Moreover, apart from the arrangement that the sound emitting surface 145 of the speaker unit 144 faces a downward direction, the sound emitting surface 145 of the speaker unit 144 can also be obliquely disposed as long as the vertical cross-sectional area of the speaker unit 144 can be reduced.

Refer to FIG. 7. The surrounding of the unitary shell component 141*b* can be sealed using an airtight strip S. The airtight strip S can be sealed at the connection between the unitary shell component 141*b* and the rear case 120 to generate a sealed rear sound box R.

According to the embodiments of the present invention, the display allows the installation of sound emitting device without changing the appearance of the display or increasing the size of the decking board or the area of the sound outlet, and complies the slim design of the display. Moreover, the number of sound emitting devices of the present embodiment can be one or several, and the sound emitting device is not limited to the way of being disposed under the display. For example, the sound emitting device can be disposed on the two sides of the front frame or at the rear of the rear case. The sound emitting device can change the sound emitting direction of the speaker unit through the sound guide channel and make the sound outlet of the sound emitting device face the second direction, such that the sound emitted by the speaker unit can be propagated along a predetermined direction to achieve the desired sound field effect, such as 360° surround sound, multimedia context, high sound quality and heavy bass.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display, comprising:

a front frame;

a rear case, wherein the front frame is fixed on the rear case;

a display panel disposed between the front frame and the rear case, wherein a display surface of the display panel is exposed from the front frame, and the display panel is fixed on the front frame; and a sound emitting device, disposed between the front frame and the rear case, comprising a sound box, a speaker unit and a sound guide channel, wherein the sound box is fixed on the rear case and is arranged separately from the display panel, the speaker unit disposed in the sound box has a sound emitting surface facing a first direction, the sound guide channel is extended to the sound emitting surface, and the sound guide channel has a sound outlet facing a second direction, and the first direction is not parallel to the second direction, wherein the sound emitting surface faces a bottom side of the display panel, and the sound outlet faces a front side of the display panel, wherein a width of the sound outlet is smaller than a width of the sound emitting surface, wherein the sound box comprises a unitary shell component on which the speaker unit is disposed and the sound guide channel is fixed, and a gap between the unitary shell component and the sound guide channel forms the sound outlet.

2. The display according to claim 1, wherein the front frame comprises a decking board, which comprises a sound outlet decking portion opposite to the sound outlet.

3. The display according to claim 1, wherein a space between the speaker unit and the sound box forms a rear sound box.

4. The display according to claim 1, wherein the sound guide channel has a sound guide bevel inclined with respect to the sound emitting surface, and when the speaker unit emits a sound propagated along the first direction, the sound is reflected by the sound guide bevel to be propagated along the second direction.

5. The display according to claim 1, wherein the sound guide channel and the sound box are integrally formed in one piece, or the sound guide channel is fixed on the sound box.

6. A display, comprising:

a front frame;

a rear case, wherein the front frame is fixed on the rear case;

a display panel disposed between the front frame and the rear case, wherein a display surface of the display panel is exposed from the front frame, and the display panel is fixed on the front frame; and a sound emitting device, disposed between the front frame and the rear case, comprising a sound box, a speaker unit and a sound guide channel, wherein the sound box is fixed on the rear case and is arranged separately from the display panel, the speaker unit disposed in the sound box has a sound emitting surface facing a first direction, the sound guide channel is extended to the sound emitting surface, the sound guide channel has a sound outlet, and an area of the sound outlet is smaller than an area of the sound emitting surface, wherein the sound emitting surface faces a bottom side of the display panel, and the sound outlet faces a front side of the display panel, wherein the sound box comprises a unitary shell component on which the speaker unit is disposed and the sound guide channel is fixed, and a gap between the unitary shell component and the sound guide channel forms the sound outlet.

7. The display according to claim 6, wherein the front frame comprises a decking board, and the decking board comprises a sound outlet decking portion opposite to the sound outlet.

8. The display according to claim 6, wherein a space between the speaker unit and the sound box forms a rear sound box.

9. The display according to claim 6, wherein the sound guide channel has a sound guide bevel inclined with respect to the sound emitting surface, and when the speaker unit emits a sound propagated along the first direction, the sound is reflected by the sound guide bevel to be propagated along the second direction.

10. The display according to claim 6, wherein the sound guide channel and the sound box are integrally formed in one piece, or the sound guide channel is fixed on the sound box.

11. The display according to claim 6, wherein a width of the sound outlet is smaller than a width of the sound emitting surface.

12. A sound emitting device, used for a display device, wherein the display device has a front frame, a rear case, and a display panel, the front frame is fixed on the rear case, the display panel is fixed on the front frame, the sound emitting device comprising:

a sound box;

a speaker unit, wherein the speaker unit is disposed in the sound box and has a sound emitting surface facing the first direction, wherein the sound box is fixed on the rear case and is arranged separately from the display panel, wherein the sound emitting surface faces a bottom side of the display panel, and the sound outlet faces a front side of the display panel; and a sound guide channel, wherein the sound guide channel is opposite to the sound emitting surface and has a sound outlet facing the second direction, and the first direction is not parallel to the second direction, wherein the sound box comprises a unitary shell component on which the speaker unit is disposed and the sound guide channel is fixed, and a gap between the unitary shell component and the sound guide channel forms the sound outlet.

13. The sound emitting device according to claim 12, wherein the sound guide channel has a sound guide bevel inclined with respect to the sound emitting surface, and when the speaker unit emits a sound propagated along the first direction, the sound is reflected by the sound guide bevel to be propagated along the second direction.

14. The sound emitting device according to claim 12, wherein an area of the sound outlet is smaller than an area of the sound emitting surface, or a width of the sound outlet is smaller than a width of the sound emitting surface.

* * * * *